US007450878B2

(12) United States Patent
Yano

(10) Patent No.: US 7,450,878 B2
(45) Date of Patent: Nov. 11, 2008

(54) IMAGE FORMING APPARATUS HAVING A PROCESS CARTRIDGE FOR RECEIVING POWER FROM A POWER SUPPLYING MEMBER

(75) Inventor: Hidetoshi Yano, Tokai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 34 days.

(21) Appl. No.: 11/473,009

(22) Filed: Jun. 23, 2006

(65) Prior Publication Data

US 2006/0291893 A1 Dec. 28, 2006

(30) Foreign Application Priority Data

Jun. 24, 2005 (JP) ..... 2005-185440

(51) Int. Cl.
*G03G 15/00* (2006.01)

(52) U.S. Cl. ..... 399/90; 399/88

(58) Field of Classification Search ..... 399/88, 399/89, 90, 111

See application file for complete search history.

(56) References Cited

U.S. PATENT DOCUMENTS 5,283,619 A 2/1994 Nomura et al.
5,768,660 A 6/1998 Kurihara et al.
6,993,264 B2 * 1/2006 Oguma et al. ..... 399/90

FOREIGN PATENT DOCUMENTS

| | | |
|---|---|---|
| JP | 5-64867 | 8/1993 |
| JP | 5-257378 | 10/1993 |
| JP | 5-303263 | 11/1993 |
| JP | 9-043939 | 2/1997 |
| JP | 9-312112 | 12/1997 |
| JP | 10-207183 | 8/1998 |
| JP | 2001-154289 | 6/2001 |

OTHER PUBLICATIONS

CN Office Action dtd Apr. 18, 2008, CN Appln. 200610095917X.

* cited by examiner

*Primary Examiner*—Hoang Ngo
(74) *Attorney, Agent, or Firm*—Banner & Witcoff, Ltd.

(57) ABSTRACT

An image forming apparatus includes a process cartridge that includes a power supplied member, a casing that includes an accommodating section for detachably accommodating the process cartridge, and a power supplying member that is provided in the accommodating section and is abutted on the power supplied member of the mounted process cartridge. The power supplying member includes a conductive wire including a winding section and two arms having the conductive wire extending from the winding section in a different direction. The accommodating section is provided with supporting sections that respectively support the two arms such that the power supplied member of the mounted process cartridge is abutted on the winding section.

8 Claims, 12 Drawing Sheets

IMAGE FORMING APPARATUS HAVING A PROCESS CARTRIDGE FOR RECEIVING POWER FROM A POWER SUPPLYING MEMBER

CROSS REFERENCE TO RELATED APPLICATION

This application claims priority from Japanese Patent Application No. 2005-185440, filed on Jun. 24, 2005, the entire subject matter of which is incorporated herein by reference.

TECHNICAL FIELD

Aspects of the present invention relate to an image forming apparatus, such as a laser printer.

BACKGROUND

An image forming apparatus, including a laser printer, is known, in which a process cartridge is detachably mounted on a main body casing. The process cartridge is provided with a developing roller, on which toner is carried, and a photosensitive drum which is disposed to face the developing roller and on which an electrostatic latent image is formed.

In such an image forming apparatus, the toner carried on the developing roller is selectively supplied to an electrostatic latent image formed on the photosensitive drum by a developing bias applied to the developing roller, when an image is formed. Then, the electrostatic latent image is developed, and a visible image is formed on the photo sensitive drum. When paper is opposed to the photosensitive drum, the visible image formed on the photosensitive drum is transferred by a transfer roller, so that an image is formed on the paper.

In the main body casing, a contact electrode coming in contact with a roller shaft of the developing roller is provided so as to apply a developing bias to the developing roller.

As such a contact electrode, a contact electrode obtained by the following process is proposed. First, conductive wire is subjected to a bending process such that a bent portion is provided in a portion of the wire. Further, one end thereof is set to a mount section, and the mount section is inserted into a frame of the apparatus. Then, the bent portion is caused to come in point contact with a counterpart electrode (For example, refer to Japanese Patent No. 3116820)

SUMMARY

In the above-described contact electrode, however, the mount section in the base end side is fixed, and a bent portion in the other end side swings. Therefore, the swing range of a free end in the other end side is inevitably increased. Then, a projected area which is required for disposing the contact electrode is enlarged so as to correspond to the swing range.

Recently, the miniaturization of an image forming apparatus is required. However, if a plurality of contact electrodes in need of such a broad projected area are disposed adjacent to each other, a current can leak between the contact electrodes, which makes it difficult to achieve the miniaturization.

Aspects of the present invention provide an image forming apparatus including a power supplying member which is suitable for the miniaturization of the apparatus.

According to an aspect of the invention, there is provided an image forming apparatus including: a process cartridge that includes a power supplied member; a casing that includes an accommodating section for detachably accommodating the process cartridge; and a power supplying member that is provided in the accommodating section and is a butted on the power supplied member of the mounted process cartridge, the power supplying member comprises a conductive wire including a winding section and two arms having the conductive wire extending from the winding section in a different direction, wherein the accommodating section is provided with supporting sections that respectively support the two arms such that the power supplied member of the mounted process cartridge is abutted on the winding section.

In the power supplying member, the winding section is abutted on the power supplied member between two arms, in a state where two arms are supported by the supporting section. That is, the winding section is abutted on the power supplied member, in a state where both ends thereof are supported. Therefore, it is possible to reduce the swing range and the projected area which is required for disposing the winding section, compared with when only one end of the winding section is supported. As a result, it is possible to achieve the miniaturization of an image forming apparatus provided with such a power supplying member.

DETAILED DESCRIPTION

1. Entire Construction of Laser Printer

Figure 1:
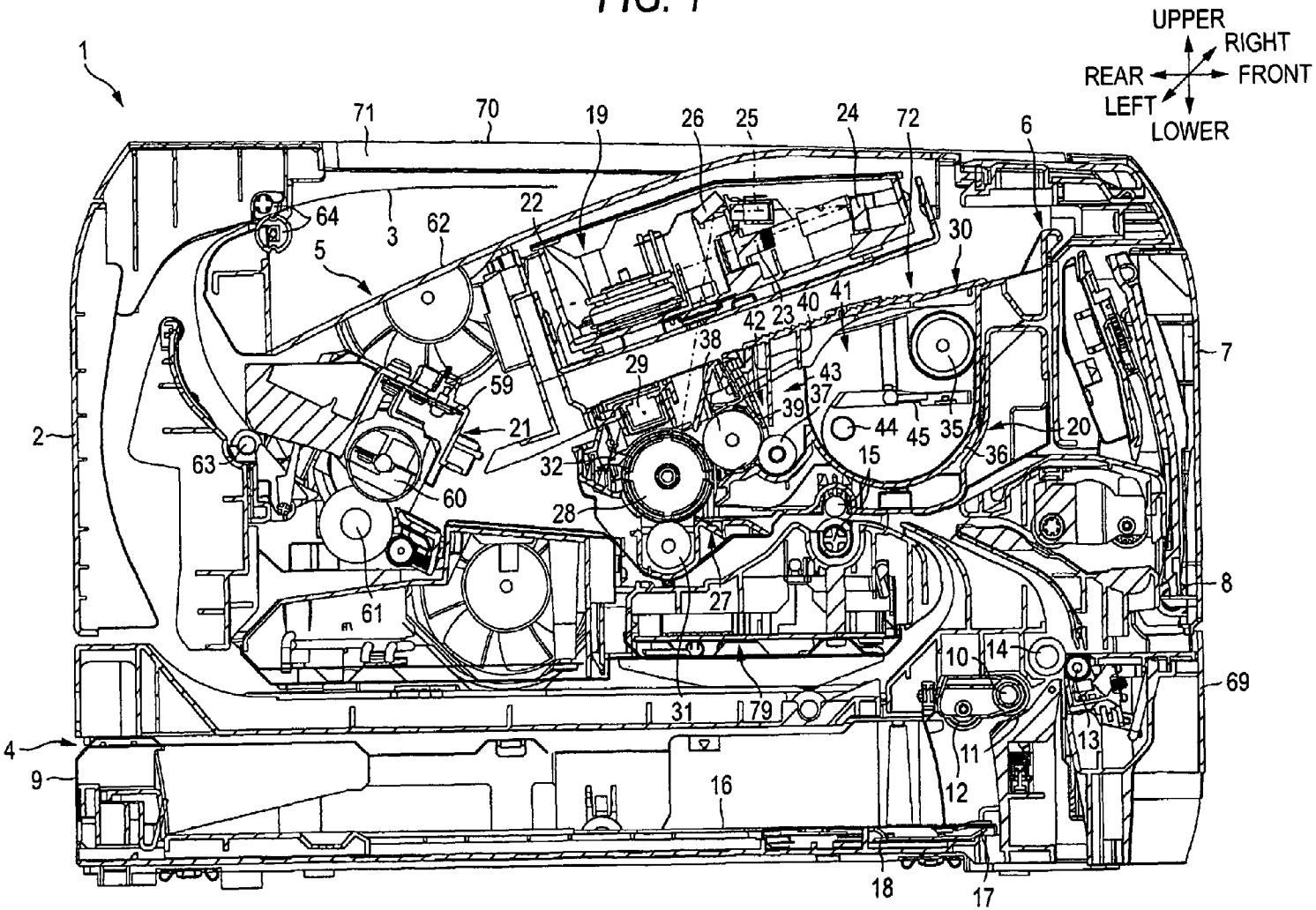
FIG. 1 is a side cross-sectional view illustrating a laser printer as an image forming apparatus according to an aspect of the present invention.
Figure 2:
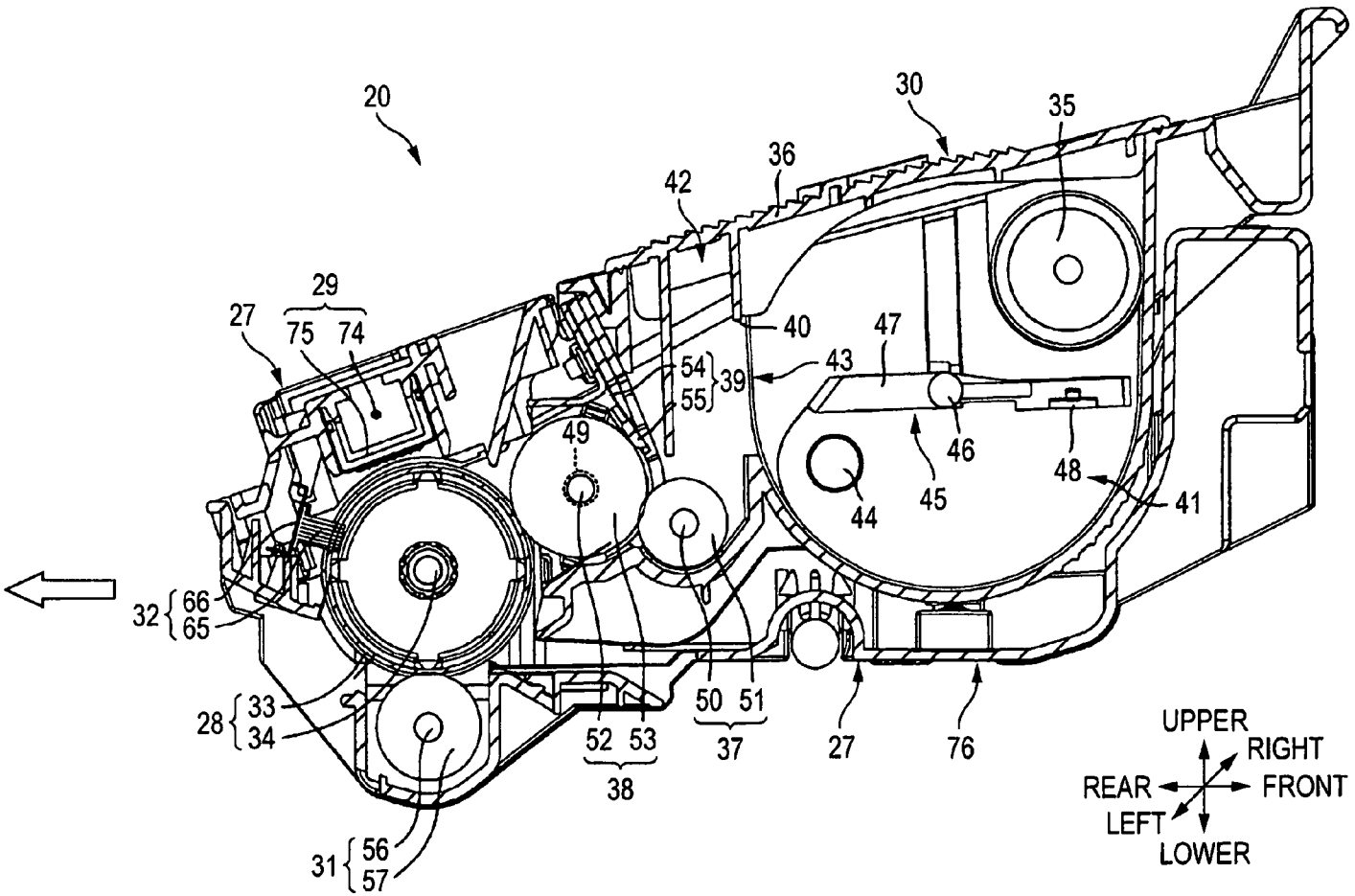
FIG. 2 is a side cross-sectional view illustrating a process cartridge of the laser printer shown in FIG. 1.
Figure 3:
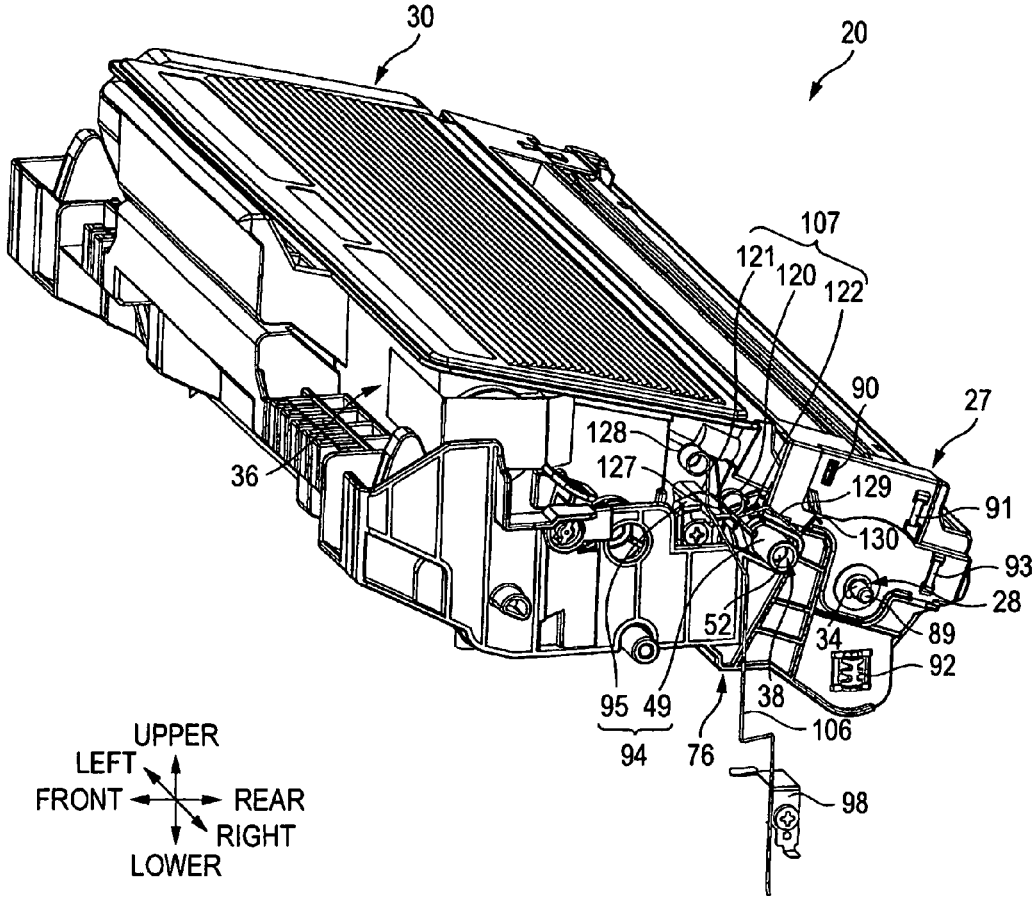
FIG. 3 is a perspective view illustrating the process cartridge shown in FIG. 2, seen from the front side.
Figure 4:
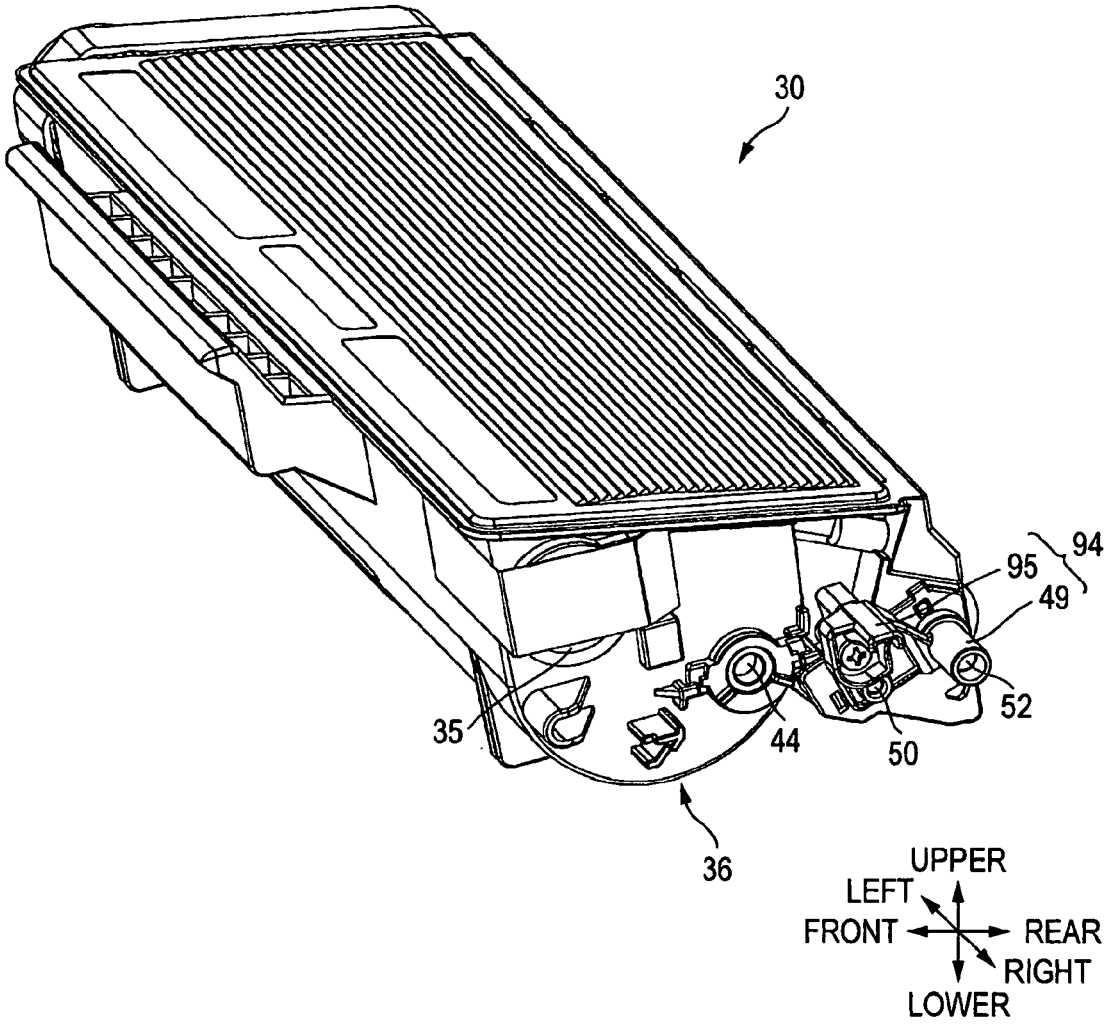
FIG. 4 is a perspective view illustrating a developing cartridge provided in the process cartridge shown in FIG. 3, seen from the front side.

FIG. 1 is a side cross-sectional view illustrating a laser printer as an image forming apparatus according to an aspect of the present invention. FIG. 2 is a side cross-sectional view illustrating a process cartridge of the laser printer shown in FIG. 1. FIG. 3 is a perspective view illustrating the process cartridge shown in FIG. 2, seen from the front side. FIG. 4 is a perspective view illustrating a developing cartridge provided in the process cartridge shown in FIG. 3, seen from the front side.

As shown in FIG. 1, the laser printer 1 is provided with a main body casing 2, a feeder section 4 for feeding paper 3 housed in the main body casing 2, and an image forming section 5 for forming an image on the fed paper 3.

(1) Main Body Casing

The box-shaped main body casing 2 has a cartridge accommodating section 72 formed therein, by which a process cartridge 20 to be described below is detachably housed.

In one side wall (front-side wall 69) of the main body casing 2, an attaching/detaching opening 6 is formed to communicate with the cartridge accommodating section 72, and a front cover 7 for opening and closing the attaching/detaching opening 6 is provided. The front cover 7 is rotatably supported by a cover shaft 8 inserted into the lower end portion thereof. Accordingly, if the front cover 7 is closed with the cover shaft 8 being set to a supporting point, the attaching/detaching opening 6 is closed by the front cover 7. If the front cover 7 is opened with the cover shaft 8 being set to a supporting point, the attaching/detaching opening 6 is opened. Through the attaching/detaching opening 6, the process cartridge 20 can be attached and detached to and from the cartridge accommodating section 72.

Hereinafter, in a state where the process cartridge 20 is mounted on the cartridge accommodating section 72 of the main body casing 2, the side where the front cover 7 is provided is set to 'the front side', the opposite side thereto is set to 'the rear side', this side of FIG. 1 is set to 'the left side', and the far side thereof is set to 'the right side', with reference to FIG. 1.

(2) Feeder Section

The feeder section 4 is provided with a paper feed tray 9 which is detachably mounted on the bottom portion within the main body casing 2 along the front and rear direction; a separation roller 10 and separation pad 11 which are provided in the upper and lower sides of the front end portion of the paper feed tray 9; and a paper feed roller 12 which is provided in the rear side (the upstream side in the conveying direction of paper 3 with respect to the separation pad 11) of the separation roller 10. Further, the feeder section 4 is provided with a paper dust removing roller 13, which is provided in the front and upper side (the downstream side in the conveying direction of paper 3 with respect to the separation roller 10) of the separation roller 10; and a pinch roller 15 which is disposed to face the paper dust removing roller 13.

A conveying path of paper 3 in the paper-feed side is folded in a U-shape from the vicinity of the paper dust removing roller 13 to the rear side. In the further downstream side of the conveying direction, the feeder section 4 is provided with a pair of registration rollers 15 in the lower side of the process cartridge 20.

Inside the paper feed tray 9, a paper pressing plate 16 is provided, on which the paper 3 can be loaded. With the rear end of the paper pressing plate 16 being swingably supported, the paper pressing plate 16 can swing between a loading position and a supply position. In the loading position, the front end thereof is disposed downward so that the paper pressing plate 16 follows the bottom plate of the paper feed tray 9. In the supply position, the front end thereof is disposed upward so that the paper pressing plate 6 is inclined.

In the front end portion of the paper feed tray 9, a lever 17 is provided so as to lift the front end portion of the paper pressing plate 16. Since the rear end portion of the lever 17 is swingably supported by a lever shaft 18 in the lower position of the front end portion of the paper pressing plate 16, the front end portion of the lever 17 can be laid on the bottom plate of the paper feed tray 9 and can lift the paper pressing plate 16. Further, if a driving force is input to the lever shaft 18, the lever 17 is rotated around the lever shaft 18 serving a supporting point, and the front end portion of the lever 17 lifts the front end portion of the paper pressing plate 16 so that the paper pressing plate 16 is moved to a supply position.

If the paper pressing plate 16 is positioned in the supply position, the uppermost paper 3 on the paper pressing plate 16 is pressed by the paper feed roller 12. Then, by the rotation of the paper feed roller 12, the paper 3 starts to be fed toward the separation position between the separation roller 10 and the separation pad 11.

If the paper feed tray 9 is detached from the main body casing 2, the paper pressing plate 16 is positioned in a loading position. If the paper pressing plate 16 is positioned in the loading position, the paper 3 can be loaded on the paper pressing plate 16 in a stacked state.

The papers 3 delivered toward the separation position by the separation roller 12 are fed one by one by the rotation of the separation roller 10, when being interposed between the separation roller 10 and the separation pad 11. The fed paper 3 is passed between the paper dust removing roller 13 and the pinch roller 14, in which the paper dust thereof is removed. Then, the paper 3 is folded along the U-shaped paper-feed-side conveying path so as to be conveyed toward the registration roller 15.

After certain registration, the registration roller 15 conveys the paper 3 to a transfer position in which a toner image on a photo sensitive drum 28 is transferred onto the paper 3 between the photosensitive drum 28 serving as a photosensitive member and a transfer roller 31.

(3) Image Forming Section

The image forming section 5 is provided with a scanner section 19, the process cartridge 20, and a fixing section 21.

(a) Scanner Section

The scanner section 19 provided in the upper portion within the main body casing 2 is provided with a laser light source (not shown), a polygon mirror 22 which is rotationally driven, an fθ lens 23, a reflecting mirror 24, a lens 25, and a reflecting mirror 26. As shown by a chained line of FIG. 1, a laser beam based on the image data emitted from the laser light source is deflected by the polygon mirror 22 so as to pass through the fθ lens 23. Then, the light path of the laser beam is folded by the reflecting mirror 24 so that the laser beam passes through the lens 25. After that, the light path thereof is bent downward by the reflecting mirror 26, so that the laser beam is irradiated on the surface of the photosensitive drum 28 of the process cartridge 20.

(b) Process Cartridge

In the lower side of the scanner section 19 within the main body casing 2, the process cartridge 20 is mounted so as to be attached and detached to and from the cartridge accommodating section 72 of the main body casing 2 through the attaching/detaching opening 6.

As shown in FIG. 2, the process cartridge 20 is provided with a drum cartridge 27 and a developing cartridge 30 that is detachably mounted on the drum cartridge 27.

(b-1) Drum Cartridge

The drum cartridge 27 is provided with a drum-side casing 76, the photosensitive drum 28, a scorotron-type charger 29, the transfer roller 29, and a cleaning member 32, which are provided in the drum-side casing 76.

The cylindrical photosensitive drum 28 is provided with a drum main body 33 serving as a photosensitive cylinder section, which is formed by a positively-charged photosensitive layer of which the uppermost surface layer is composed of polycarbonate or the like, and a metallic drum shaft 34 serving as a shaft section which extends along the axial direction of the drum main body 33 in the axis center of the drum main body 33. The drum shaft 34 is supported by both side walls of the drum-side casing 76, and the drum main body 33 is rotatably supported around the drum shaft 34. Accordingly, the photosensitive drum 28 is provided so as to rotate around the drum shaft 34 in the drum-side casing 76. Further, the photosensitive drum 28 is rotationally driven when a driving force from a motor (not shown) is input.

As shown in FIG. 3, the drum shaft 34 of the photosensitive drum 28 is formed so as to project outward in the width direction (left and right direction) from both side walls of the drum-side casing 76. The end surface parallel to the right end of the width direction is set to an earth contact 89.

As shown in FIG. 2, the scorotron-type charger 29 provided in the oblique rear and upper side of the photosensitive drum 28 is supported by the drum-side casing 76. Further, the scorotron-type charger 29 is spaced so as not to come in contact with the photosensitive drum 28 and is disposed to face the photosensitive drum 28. The scorotron-type charger 29 is provided with a discharge wire 74, which is spaced at a distance with the photosensitive drum 28 and is disposed to face the photosensitive drum 28, and a grid 75 which is provided between the discharge wire 74 and the photosensitive drum 28 so as to control an amount of charge from the discharge wire 74 to the photosensitive drum 28.

As shown in FIG. 3, a discharge-wire electrode 90 and a grid electrode 91 are provided on the outer surface of the right-side wall of the drum-side casing 76. The discharge-wire electrode 90 is disposed in the oblique upper and front side with respect to the earth contact 89. Further, the grid electrode 91 is disposed in the oblique upper and rear side with respect to the earth contact 89.

The discharge wire electrode 90 and the discharge wire 74 are electrically connected, and the grid electrode 91 and the grid 75 are electrically connected. Therefore, in the scorotron-type charger 29, a grid bias is applied to the grid 75 through the discharge wire electrode 90, and simultaneously, a high voltage is applied to the discharge wire 74 through the grid electrode 91, in a state where the process cartridge 20 is mounted on the cartridge accommodating section 72. Further, when the discharge wire 74 is corona-discharged, the surface of the photosensitive drum 28 is positively charged uniformly.

As shown in FIG. 2, the transfer roller 31 is provided in the lower side of the photosensitive drum 28 in the drum-side casing 76. The transfer roller 31 is disposed to face the photosensitive drum 28 in the upward and downward direction so as to come in contact with the photosensitive drum 28. Further, the transfer roller 31 is disposed so that a nip is formed between the photosensitive drum 28 and the transfer roller 31. The transfer roller 31 is provided with a metallic transfer roller shaft 56 and a rubber roller 57 which is formed of a conductive rubber material so as to cover the transfer roller shaft 56. The transfer roller shaft 56 is rotatably supported by both side walls of the drum-side casing 76. The transfer roller 31 is rotationally driven when a driving force from a motor (not shown) is input. As shown in FIG. 3, a transfer roller electrode 92 is provided on the outer surface of the right side wall of the drum-side casing 76. The transfer roller electrode 92, disposed in the lower side of the earth contact 89, is electrically connected to the transfer roller shaft 56. Therefore, in the transfer roller 31, a transfer bias is applied through the transfer roller electrode 92, in a state where the process cartridge 20 is mounted on the cartridge accommodating section 72.

As shown in FIG. 2, the cleaning member 32, which is assembled into the drum-side casing 76, is disposed in the rear side of the photosensitive drum 28 so as to face the photosensitive drum 28. The cleaning member 32 is provided with a cleaning brush 65 for capturing the paper dust attached on the photosensitive drum 28 and a supporting plate 66 which is disposed in the opposite (rear) side of the photosensitive drum 28 with respect to the cleaning member 65 so as to support the cleaning brush 65.

The cleaning brush 65, composed of a nonwoven fabric in which a larger number of conductive brush hairs are implanted, is bonded to the supporting plate 66 by a two-sided tape. The cleaning brush 65 is disposed so as to come in contact with the photosensitive drum 28.

The supporting plate 66 is assembled into the drum-side casing 76, while supporting the cleaning brush 65.

As shown in FIG. 3, a cleaning member electrode 93 is provided on the outer surface of the right side wall of the drum-side casing 76. The cleaning member electrode 93 is disposed in the rear side with respect to the earth contact 89 and is electrically connected to the supporting plate 66. Therefore, in the supporting plate 66 and the cleaning brush 65, a cleaning bias is applied through the cleaning-member electrode 93, in a state where the process cartridge 20 is mounted on the cartridge accommodating section 72.

(b-2) Developing Cartridge

As shown in FIGS. 3 and 4, the developing cartridge 30 is disposed to be attached and detached to and from the drum cartridge 27, in a state where the process cartridge 20 is detached from the cartridge accommodating section 72 of the main body casing 2.

As shown in FIG. 2, the developing cartridge 30 is provided with a developing-side casing 36, a supply roller 37, a developing roller 38, and a layer thickness regulating blade 39, which are provided in the developing-side casing 36.

The developing-side casing 36 is formed in a box shape of which the rear side can be opened. Inside the developing-side casing 36, a partition wall 40, a toner containing chamber 41, and a developing chamber 42 are provided. The toner containing chamber 41 and the developing chamber are partitioned by the partition wall 40.

The partition wall 40 is disposed in the middle of the front and rear direction of the developing-side casing 36. Further, the partition wall 40 has an opening 43 formed in the middle of the upward and downward direction so as to partition the inside of the developing-side casing 36 in the front and rear direction.

The toner containing chamber 41 is defined as the front-side internal space of the developing-side casing 36 partitioned by the partition wall 40. Inside the toner containing chamber 41, a positively chargeable mono-component non-magnetic toner is contained as a developer. As the toner, a polymerizable toner is used, which is obtained by copolymerizing polymerizable monomers, for example, styrene-based monomers, such as styrene, or acrylic monomers, such as acrylic acid, alkyl (C1 to C4) acrylate, alkyl (C1 to C4) methacrylate and the like, through suspension polymerization. The polymerizable toner is formed in a substantially spherical shape such that the fluidity thereof is extremely favorable. Therefore, it is possible to form an image with a high quality.

In such a toner, a coloring agent, such as carbon black, or wax, is combined. Further, in order to improve fluidity, an external additive, such as silica, is added. The average particle diameter of the toner ranges from 6 to 10 μm.

In the toner containing chamber 41, a toner supply port for filling toner is formed on the side wall of the developing-side casing 36. The toner supply port is closed by a toner cap 35.

In the toner containing chamber 41, toner-detection windows 44 for detecting a remaining amount of toner are formed on both side walls of the developing-side casing 36. The toner-detection windows 44 are formed in the vicinity of the partition wall 40 on both side walls of the developing-side casing 36 so as to face each other along the width direction (that is, the above-described left and right direction). Each of the toner-detection windows 44 is formed by burying a transparent disc into the side wall of the developing-side casing 36.

Inside the toner containing chamber 41, an agitator 45 for agitating toner is provided. The agitator 45 is provided with an agitator rotating shaft 46 and an agitating member 47.

The agitator rotating shaft 46 is rotatably supported in the substantial center of the toner containing chamber 41 by both side walls of the developing-side casing 36. The agitating member 47 is provided in the agitator rotating shaft 46.

The agitator 45 is provided with a pair of wipers 48. The pair of wipers 48 is attached to both end portions of the axial direction of the agitator shaft 46. If the agitator rotating shaft 46 rotates, the respective wipers 48 move the toner containing chamber 41 in the circumferential direction around the agitator rotating shaft 46 so as to wipe the respective toner-detection windows 44 provided in both side walls of the developing-side casing 36. Accordingly, the respective toner-detection windows 44 are cleaned by the wipers 48.

The developing chamber 42 is defined as the internal space of the rear side of the developing-side casing 36 partitioned by the partition wall 40.

In the developing chamber 42, the supply roller 37 is disposed in the rear side of the opening 43. The supply roller 37 is provided with a metallic supply roller shaft 50 and a sponge roller 51 which is made of a conductive foamed material so as to cover the supply roller shaft 50. The supply roller shaft 50 is rotatably supported by both side walls of the developing-side casing 36 in the developing chamber 42. The supply roller 37 is rotationally driven when a driving force from a motor (not shown) is input to the supply roller shaft 50.

In the developing chamber 42, the developing roller 38 is disposed in the rear side of the supply roller 37. The developing roller 38 is provided so as to come in contact with the supply roller 37 in a state where the developing roller 38 and the supply roller 37 are pressed to each other. The developing roller 38 is provided with a metallic developing roller shaft 52 serving as a roller shaft and a rubber roller 53 serving as a roller section which is made of a conductive rubber material so as to cover the developing roller shaft 52. The developing roller shaft 52 is rotatably supported in the developing chamber 42 by both side walls of the developing-side casing 36. The rubber roller 53, formed of conductive urethane rubber or silicon rubber including carbon particles and the like, is covered with a coat layer made of urethane rubber or silicon rubber. The developing roller 38 is rotationally driven when a driving force from a motor (not shown) is input to the developing roller shaft 52.

As shown in FIGS. 3 and 4, the developing roller shaft 52 is formed to project outward in the width direction from either side wall of the developing-side casing 36. On the outer surface of the right side wall of the developing-side casing 36, a power supplying member 94 is provided so as to be electrically connected to the developing roller shaft 52. The power supplying member 94 is provided with a cylindrical collar section 49, which is formed of conductive resin so as to cover the right shaft end of the developing roller shaft 52, and a developing-roller electrode 95 serving as a conducting shaft section which is disposed in the front side of the collar section 49. The collar section 49 and the developing-roller electrode 95 are integrally formed. The developing-roller electrode 95 is formed in a U-shape, of which the lower side is opened, seen from the side. Further, the developing roller electrode 95 is formed in parallel to the right shaft end of the developing roller shaft 52 so as to extend outward in the width direction of the developing-side casing 36. In the collar section 49, the developing roller shaft 52 is rotationally disposed in a state where the outer circumference of the developing roller shaft 52 and the inner circumference of the collar section 49 come in sliding contact with each other. Therefore, the developing roller shaft 52 and the developing roller electrode 95 are electrically connected to each other. In the developing roller 38, a developing bias is applied through the developing roller electrode 95 of the power supplying member 94 and the collar member 49, in a state where the process cartridge 20 is mounted on the cartridge accommodating section 72.

In a state where the developing cartridge 30 is mounted on the drum cartridge 27, the collar section 49 is abutted on the right sidewall of the drum-side casing 76, and the developing roller electrode 95 is disposed so as to project outward in the width direction from the right side wall of the drum-side casing 76, as shown in FIG. 3.

As shown in FIG. 2, the layer thickness regulating blade 39 is provided with a blade main body 54 made of a metallic plate spring material and a pressing section 55 made of insulating silicon rubber. The pressing section 55, of which the cross-section is formed in a semi-circular shape, is provided in a feed end part of the blade main body 54. In the layer thickness regulating blade 39, the base end portion of the blade main body 54 is supported in the upper side of the developing roller 38 by the developing-side casing 36, so that the pressing section 55 is pressed on the developing roller 38 by an elastic force of the blade main body 54.

(b-3) Developing Transfer Operation

When a driving force from a motor (not shown) is input into the agitator rotating shaft 46, the agitator rotating shaft 46 is rotated, and the agitating member 47 moves the toner containing chamber 41 in the circumferential direction around the agitator rotating shaft 46. Then, the toner contained in the toner containing chamber 41 is agitated by the agitating member 47 and is discharged toward the developing chamber 42 from the opening 43 communicating in the front and rear direction in the middle of the upward and downward direction of the partition wall 40.

The toner discharged from opening 43 toward the developing chamber 42 is supplied to the developing roller 38 by the rotation of the supply roller 37. At this time, a positive frictional charge is applied between the supply roller 37 and the developing roller 38. The toner supplied on the developing roller 38 enters between the pressing section 55 of the layer thickness regulating blade 39 and the rubber roller 53 of the developing roller 53 with the rotation of the developing roller 38. Then, the toner as a thin layer with a constant thickness is carried on the developing roller 38.

Meanwhile, the surface of the photosensitive drum 28 is uniformly positively-charged by the scorotron-type charger 29 in accordance with the rotation of the photosensitive drum 28. Then, the surface is exposed by high-speed scanning of the laser beam from the scanner section 19, so that an electrostatic latent image corresponding to an image to be formed on the paper 3 is formed.

Next, when the toner which is positively charged and carried on the developing roller 38 is caused to come in contact with the photosensitive drum 28 by the rotation of the developing roller 38, the toner is supplied to the electrostatic latent image formed on the surface of the photosensitive drum 28, that is, to a portion, which is exposed to a laser beam so that the potential thereof drops, in the surface of the photosensitive drum 28 which is uniformly positively charged. Accordingly, the electrode static latent image of the photosensitive drum 28 is visualized, so that a toner image as a visible image, obtained by reversal development, is carried on the surface of the photosensitive drum 28.

After that, the toner image carried on the surface of the photo sensitive drum 28 is transferred on to the paper 3 by a transfer bias applied to the transfer roller 31, while the paper 3 conveyed by the resist roller 15 passes through the transfer position between the photosensitive drum 28 and the transfer roller 31, as shown in FIG. 1. The paper 3 on which the toner image is transferred is conveyed by the fixing section 21.

The toner remaining on the surface of the photosensitive drum 28 after transfer is collected by the developing roller 38. Further, the paper dust from the paper 3, attached on the surface of the photosensitive drum 28 after transfer, is removed from the surface of the photosensitive drum 28 by the cleaning member 32.

(c) Fixing Section

As shown in FIG. 1, the fixing section 21 provided in the rear side of the process cartridge 20 is disposed so as to be spaced at a distance with the photo sensitive drum 28 of the process cartridge 20 in the front and rear direction. The fixing section 21 is provided with a fixing frame 59, a heating roller 60, and a pressing roller 61. The heating roller 60 and the pressing roller 61 are provided in the fixing frame 60.

The heating roller 60 is provided with a metallic tube, of which the surface is coated with fluorine resin, and a halogen lamp for heating which is inserted into the metallic tube. The heating roller 60 is rotationally driven when a driving force from a motor (not shown) is input.

In the lower side of the heating roller 60, the pressing roller 61 is disposed so as to press the heating roller 60. The pressing roller 61 is provided with a metallic roller shaft and a rubber roller made of a rubber material which covers the roller shaft. The pressing roller 61 is driven in accordance with the rotational driving of the heating roller 60.

While the paper 3 is passed between the heating roller 60 and the pressing roller 61, the fixing section 21 thermally fixes the toner image transferred onto the paper 3 in the transfer position. The paper 3 on which the toner image is fixed is conveyed toward a paper discharge tray 62 formed on the upper surface of the main body casing 2.

The paper-discharge-side conveying path of the paper 3 from the fixing section 21 to the discharge tray 62 is folded in a substantial U-shape to the front side from the fixing section 21. In the middle of the paper-discharge-side conveying path, a conveying roller 63 is provided. Further, in the downstream end portion of the paper-discharge-side conveying path, a paper discharge roller 64 is provided.

The paper 3 thermally fixed by the fixing section 21 is conveyed to the paper-discharge-side conveying path and is conveyed to the paper discharge roller 64 by the conveying roller 63. Then, the paper 3 is discharged onto the paper discharge tray 62 by the paper discharge roller 64.

2. Mounting High-Voltage Wiring Section, Earth Section, Right-Side Wall, and Process Cartridge Next, a high-voltage wiring section 79, an earth section 82, and a right-side wall 70 of the cartridge accommodating section 72, into which the high-voltage wiring section 79 and the earth section 82 are assembled, will be described in detail. The high-voltage wiring section 79 is provided to feed electric power to the respective electrodes (that is, the discharge-wire electrode 90, the grid electrode 91, the cleaning-member electrode 93, the transfer-roller electrode 92, and the developing-roller electrode 95) of the above-described process cartridge 20, and the earth section 82 is provided to ground the earth contact 89.

Figure 5:
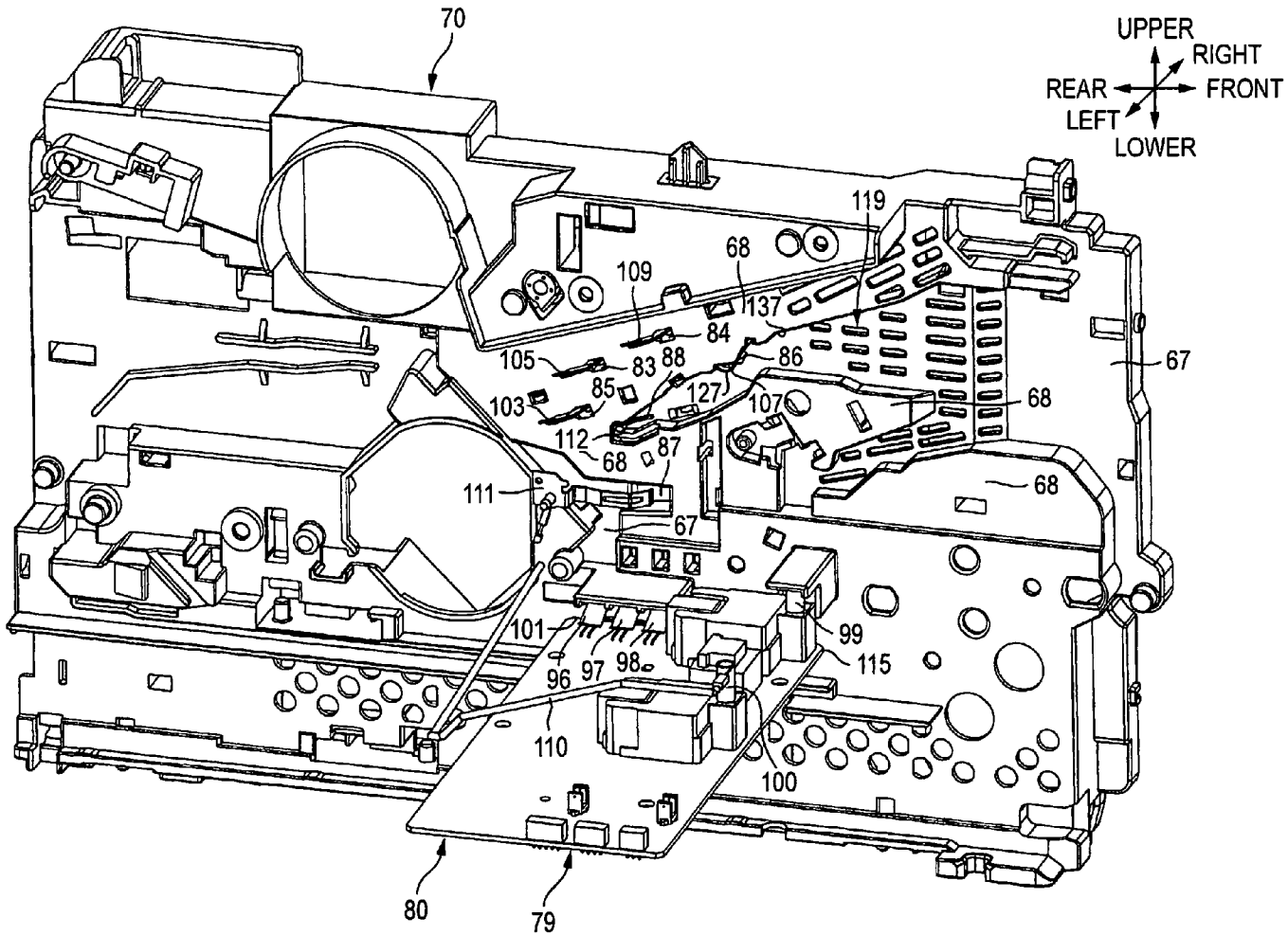
FIG. 5 is a perspective view seen from the inside of a right-side wall in a main body casing of the laser printer shown in FIG. 1.
Figure 6:
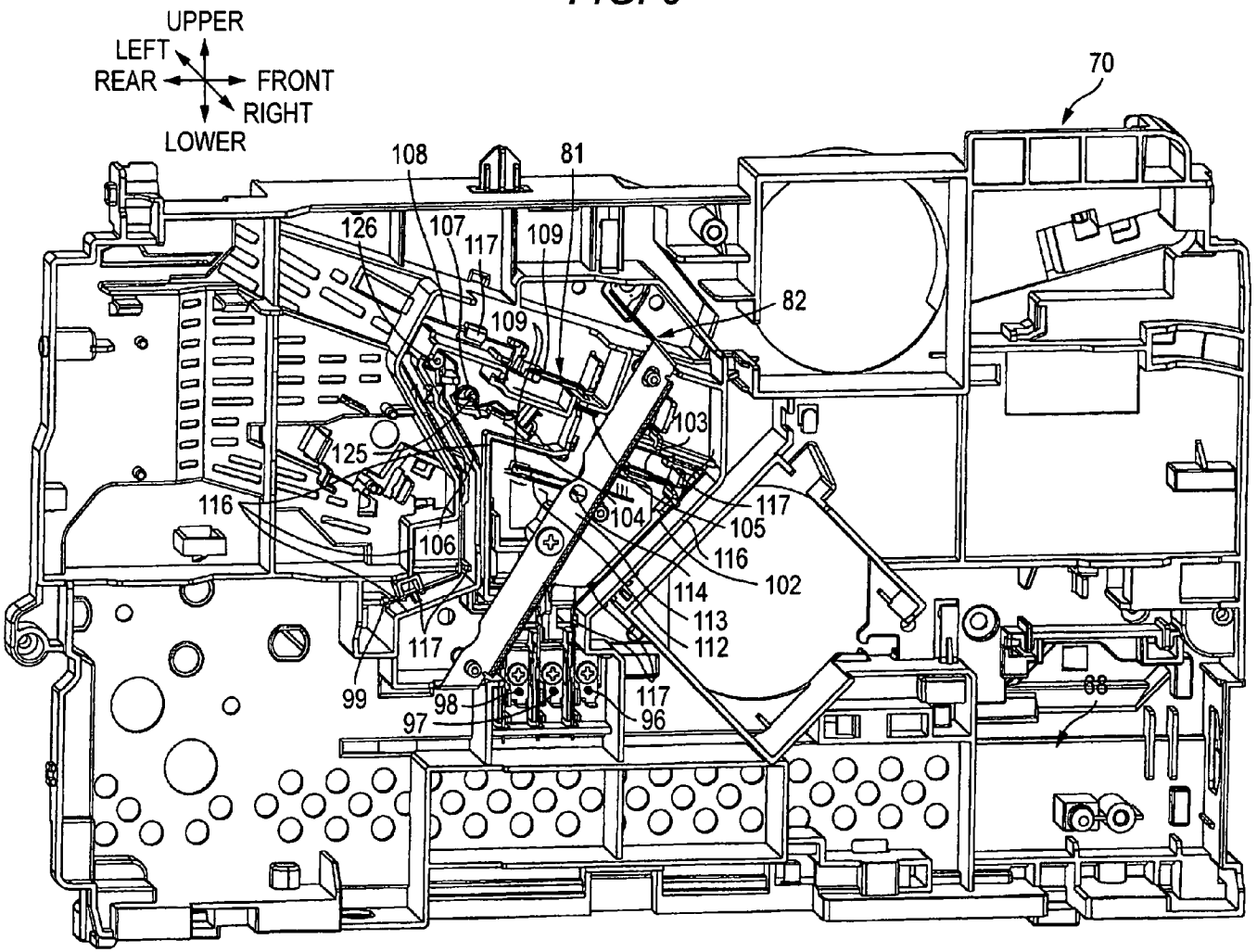
FIG. 6 is a perspective view seen from outside of the right-side wall, corresponding to FIG. 5.
Figure 7:
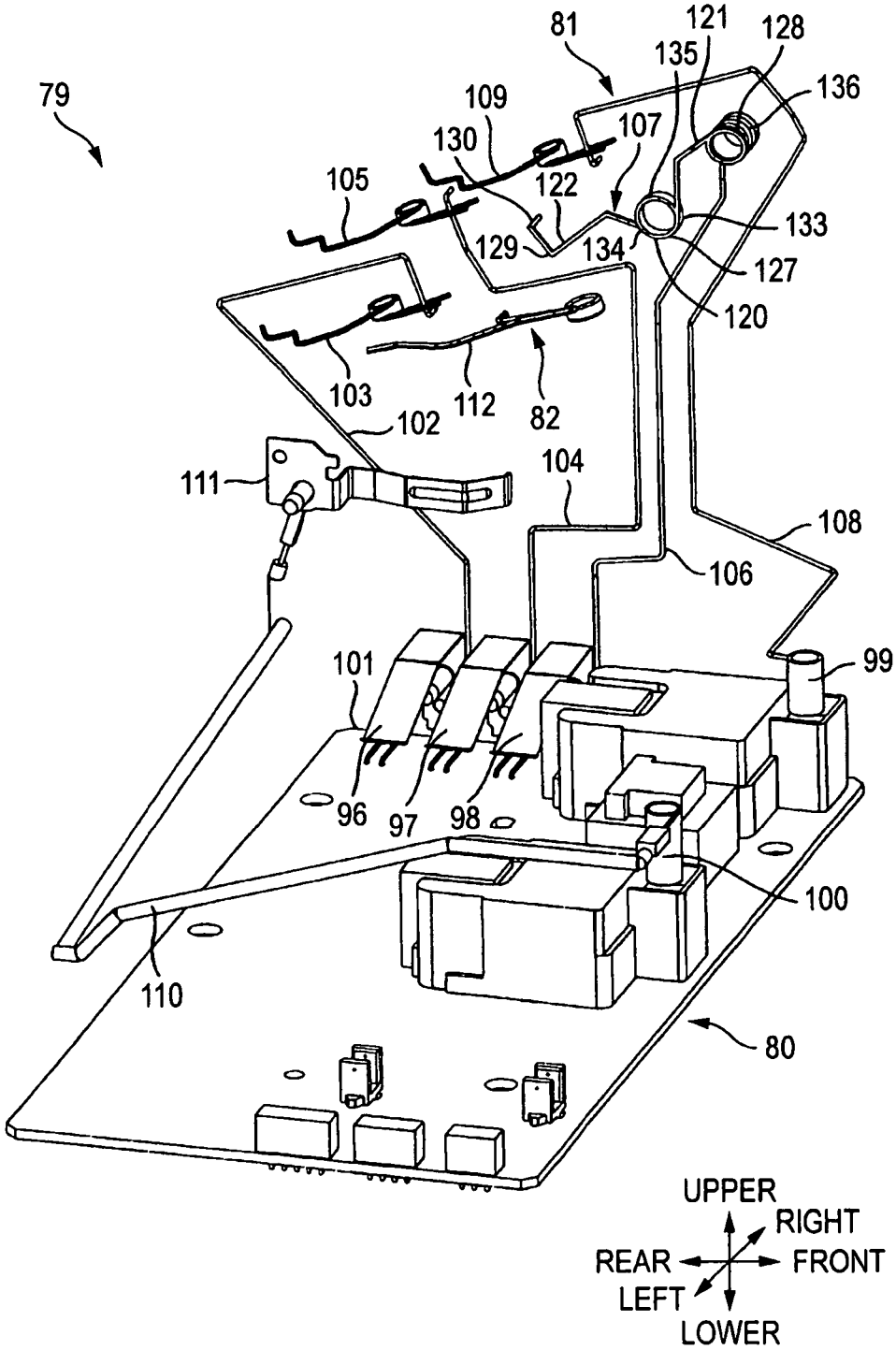
FIG. 7 is a perspective view showing a state where a wiring group is assembled into a high-voltage generating substrate, seen from the upper side.
Figure 8:
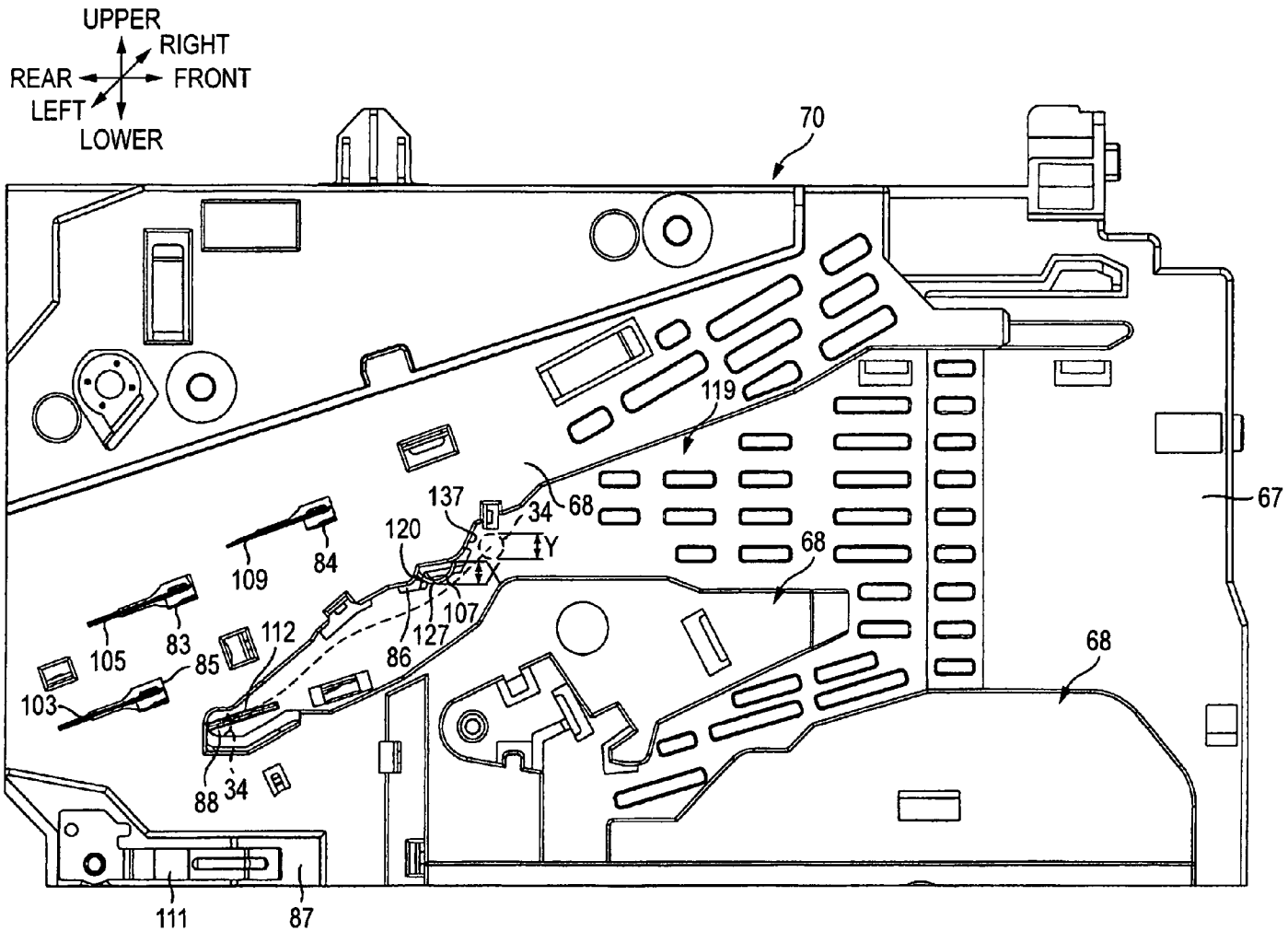
FIG. 8 is an enlarged view illustrating an exposed portion of the wiring group and the vicinity of a guide groove in the right-side wall of FIG. 5.
Figure 9:
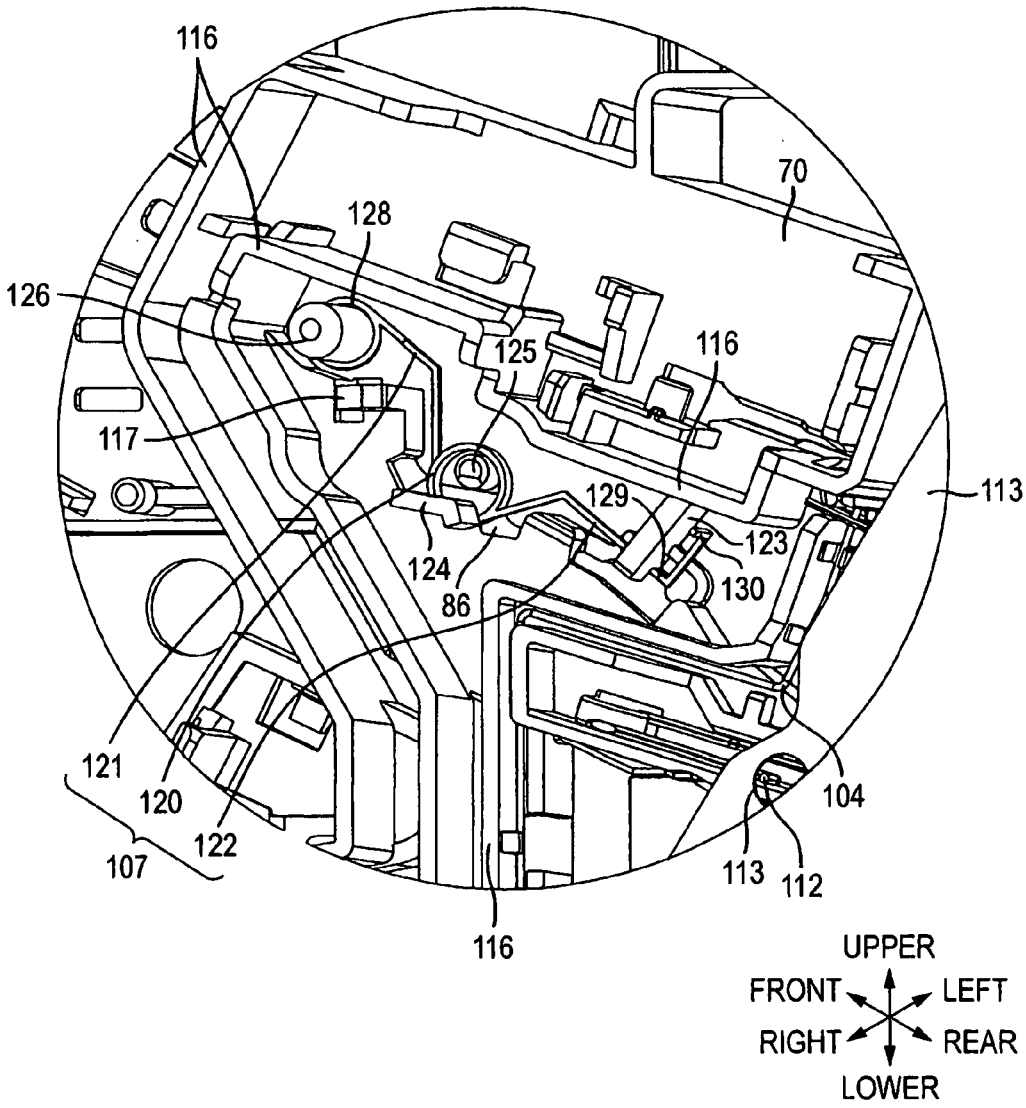
FIG. 9 is an enlarged view illustrating parts in the inner surface of the right-side wall of FIG. 6, showing a state where the developing-roller coil is mounted.
Figure 10:
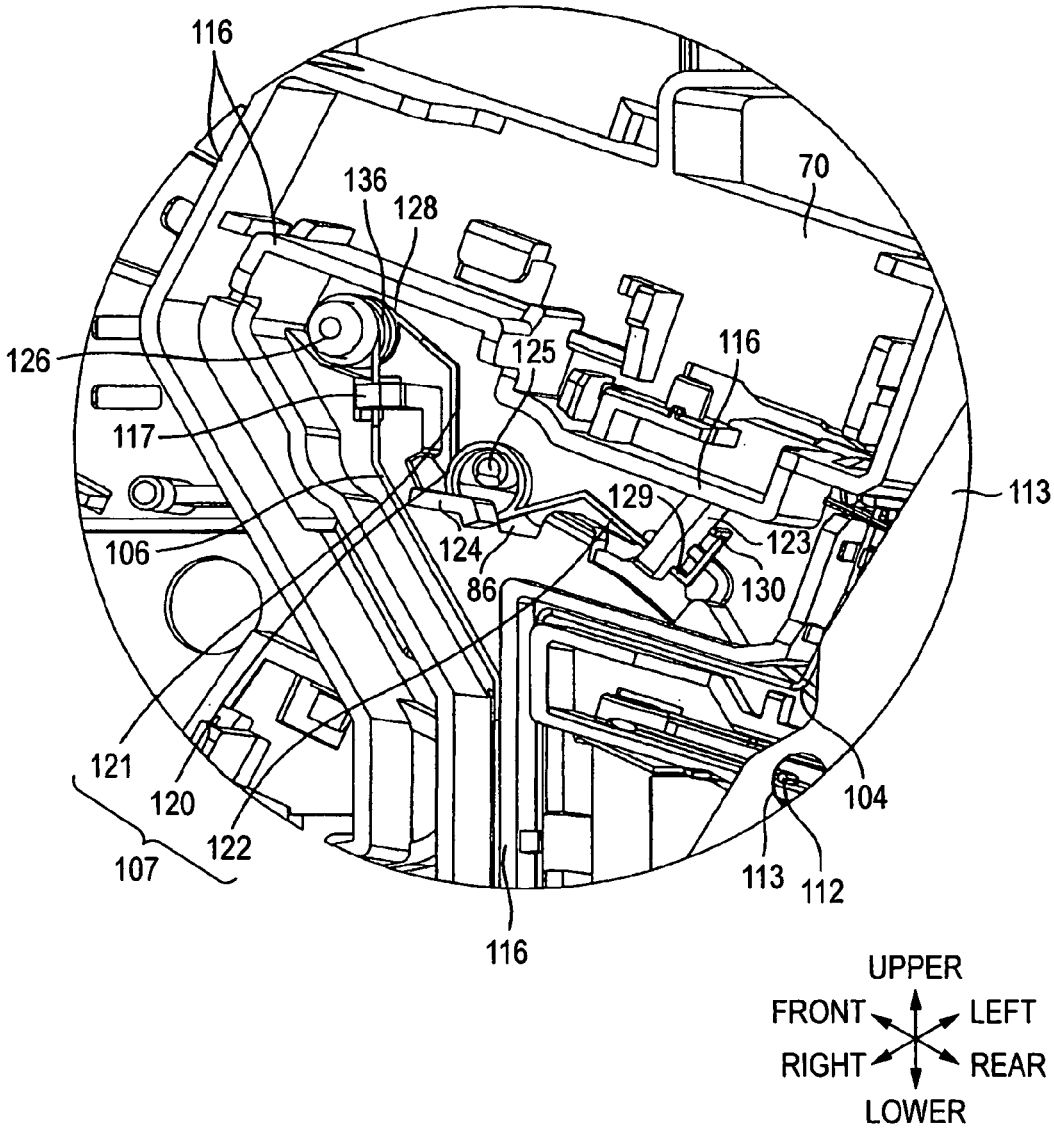
FIG. 10 is an enlarged view showing a state where the developing-roller coil and a developing-roller wire come in contact with each other.
Figure 11:
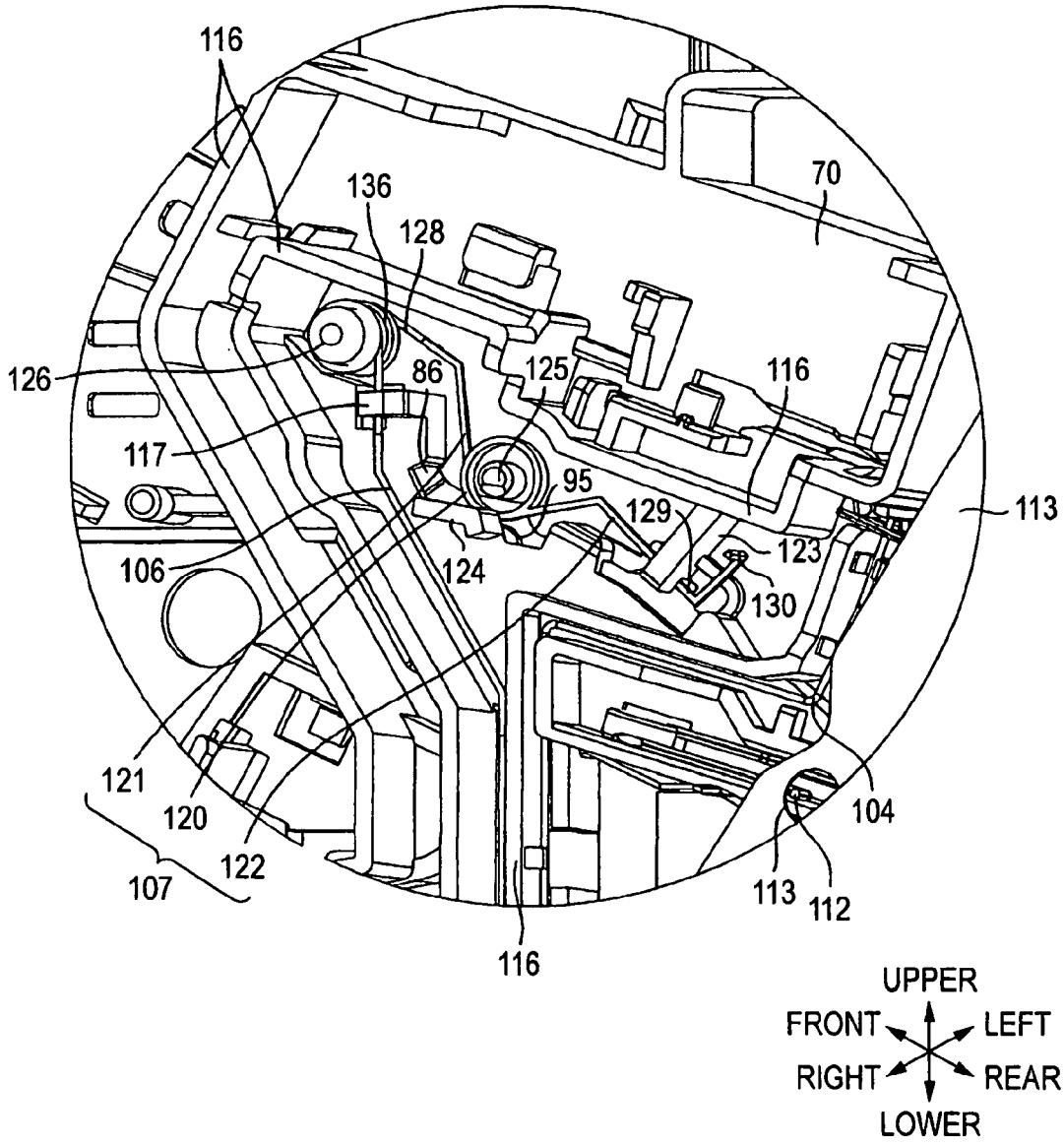
FIG. 11 is an enlarged view showing a state where the process cartridge is mounted.

FIG. 5 is a perspective view seen from the inside of the right-side wall in the main body casing of the laser printer shown in FIG. 1. FIG. 6 is a perspective view seen from the outside of the right-side wall, corresponding to FIG. 5. FIG. 7 is a perspective view showing a state where a wiring group is integrated into a high-voltage generating substrate, seen from the upper side. FIG. 8 is an enlarged view illustrating an exposed portion of the wiring group and the vicinities of a guide groove in the right-sidewall of FIG. 5. FIG. 9 is an enlarged view illustrating essential parts in the inner surface of the right-side wall of FIG. 6, showing a state where a developing-roller coil is mounted. FIG. 10 is an enlarged view showing a state where the developing-roller coil and the developing-roller wire are connected to each other in FIG. 9. FIG. 11 is an enlarged view showing a state where the process cartridge is mounted in FIG. 10.

(1) High-Voltage Wiring Section

The high-voltage wiring section 79 provided in the cartridge accommodating section 72 of the main body casing 2 is provided with a high-voltage generating substrate 80 and wiring group 81, serving as a power supply, as shown in FIG. 7.

(a) High-Voltage Generating Substrate

The high-voltage generating substrate 80, which is provided with a transformer, a capacitor and the like, amplifies a voltage supplied from an input power supply (not shown) through the transformer, stores the amplified high voltage (bias) in the capacitor, or feeds power to the wiring group 81. The high-voltage generating substrate 80 is provided with a cleaning-member terminal 96, a grid terminal 97, a developing-roller terminal 98, a discharge-wire terminal 99, and a transfer-roller terminal 100, which are connected to the base end portions of the respective wires of the wiring group 81. Further, in the right end portion of the high-voltage generating substrate 80, there is provided a locked portion 101 which is locked to the right side wall 70.

(b) Wiring Group

The wiring group 81 is provided with a plurality of wires made of conductive wires, such as metallic wires, a plurality of winding sections in which the conductive wire is wound more than one time, and a plurality of coils and plate springs having two arms formed to project so as to be spaced from each other in a tangential direction from the winding section. The wires and coils correspond to the respective electrodes.

Specifically, the wiring group 81 is provided with a cleaning-member wire 102 and cleaning-member coil 103 corresponding to the cleaning-member electrode 93; a grid wire 104 and grid coil 105 corresponding to the grid electrode 91; a developing-roller wire 106 and developing-roller coil 107 corresponding to the developing-roller electrode 95; a discharge-wire wire 108 and discharge-wire coil 109 corresponding to the discharge-wire electrode 90; and a transfer-roller wire 110 and transfer-roller plate spring 111 corresponding to the transfer-roller electrode 92. Here, the developing roller wire 106 serves as a wiring section, and the developing roller coil 107 serves as a power supplying member.

The developing-roller coil 107 is provided with a coil winding section 120, a wire-side coil arm 121 and a locking-hook-side coil arm 122. The coil winding section 120 is interposed between the wire-side coil arm 121 and the locking-hook-side coil arm 122.

Around the coil winding section 120, conductive wires are wound in more than two turns. The wire-side coil arm 121 and the locking-hook-side coil arm 122 continue from the coil winding section 120 so as to extend in a direction where they are separated.

In the coil winding section 120, a portion between a wire-side end portion 133 and a locking-hook-side end portion 134 in the circumferential direction (winding direction) is set to a broad-width portion 127, and a portion interposing the broad portion 127 in the circumferential direction is set to a narrow-width portion 135. The wire-side end portion 133 continues to the base end portion of the wire-side coil arm 121, and the locking-hook-side end portion 134 continues to the end portion of the locking-hook-side coil arm 122.

In the broad-width section 127, two conductive wires continuing from the wire-side coil arm 121 and the locking-hook-side coil arm 122 are disposed, so that the width thereof becomes large compared with the narrow-width section 135. The broad-width section 127 is formed to be thicker in the overlapping direction of the conductive wires than the narrow-width section 135.

In the free end portion of the wire-side coil arm 121, a support winding section 128 in which conductive wire is wound is provided. Further, in the free end portion of the locking-hook-side coil arm 122, a first L-shaped portion 129 and a second L-shaped portion 130 are provided, which are bent in an L-shape in a different direction from each other.

In the free end portion of the developing-roller wire 106, a wire winding section 136 is provided, serving as a connection section in which conductive wire is wound.

(2) Earth Section

The earth section 82 is provided with an earth coil 112 (refer to FIG. 7) and an earth plate 113 (refer to FIG. 6).

The earth coil 112 is provided with a winding section, in which conductive wire is wound in more than one turn, and two arms which project in the circumferential direction from the winding section.

The earth plate 113, which is an elongate conductive plate, has a hole 114 formed in the center of the longitudinal direction thereof.

(3) Right-Side Wall

In the right-side wall 70, a guide groove 119 for guiding the attachment and detachment of the process cartridge 20 is formed on the inner surface thereof, as shown in FIGS. 5 and 8. The guide groove 119 is formed in a substantial triangle shape where the upper side of the front edge of the right-side wall 70 is set to the base and the width thereof is narrowed toward the apex of the triangle positioned in the rear side. In main body casing 2, a guide groove (not shown) having the same shape as the guide groove 119 is also formed on the inner surface of the left-side wall 71 (refer to FIG. 1) opposing the right-side wall 70. The guide grooves are provided in the cartridge accommodating section 72.

In the right-side wall 70, a first inner surface 67 forming the groove bottom surface of the guide groove 119 and a second inner surface 68 disposed inward in the width direction of the first inner surface 67 are formed in a step shape, seen from the front side in the inner surface thereof.

In the right-side wall 70, a hole-shaped locking section 115 which is fitted into the locked portion 101 of the high-voltage generating substrate 80 is provided on the second inner surface 68 below the guide groove 119.

In the right-sidewall 70, a plurality of holes penetrating the inner surface and outer surface of the right side wall 70 and a plurality of concave portions (mounts) formed on the inner surface of the right side wall 70 are provided in the vicinities of the guide groove 119 above the locking section 115. The holes and the concave portion are provided so as to expose portions of the plurality of coils and plate springs of the wiring group 81 to the inside of the right-side wall 70. In the plurality of holes and concave sections (mounts), a grid electrode mount 83, a discharge-wire electrode mount 84, a cleaning-member electrode mount 85, a developing-roller electrode mount 86, and an earth-contact mount 88 are included.

The earth-contact mount 88 is formed as a hole on the first inner surface 67 in the apex (the innermost portion) of the substantial triangle shape of the guide groove 19. The cleaning-member electrode mount 85 is formed as a hole on the second inner surface 68 in the oblique rear and upper side of the earth-contact mount 88. The grid electrode mount 83 is formed as a hole on the second inner surface 68 in the upper side of the cleaning-member electrode mount 85. The discharge-wire electrode mount 84 is formed as a hole on the second inner surface 68 in the oblique front and upper side of the grid electrode mount 83. The developing-roller electrode mount 86 is formed as a hole on a groove side surface (upper groove side surface) 137 in the oblique front and lower side of the discharge-wire electrode mount 84. The groove side surface 137 is formed so as to continue to the first and second inner surfaces 67 and 68, and is disposed orthogonal to those surfaces.

The transfer-roller electrode mount 87 is formed as a concave section on the first inner surface 67 below the earth-contact mount 88.

The respective mounts are disposed in the width direction so as to face the respective electrodes and contacts of the process cartridge 20, in a state where the process cartridge 20 is mounted on the cartridge accommodating section 72. That is, the grid electrode mount 83 is disposed so as to face the grid electrode 91, and the discharge-wire electrode mount 84 is disposed so as to face the discharge-wire electrode 90. Similarly, the cleaning-member electrode mount 85 is disposed so as to face the cleaning-member electrode 93, and the developing-roller electrode mount 86 is disposed so as to face the developing-roller electrode 95. Further, the earth contact mount 88 is disposed so as to face the earth contact 89, and the transfer-roller electrode mount 87 is disposed so as to face the transfer-roller electrode 92.

As shown in FIG. 6, a guide wall 116 projecting outward in the width direction with respect to the outer surface of the right-side wall 70 is provided on the outer surface of the right-side wall 70. The guide wall 116 serves to fix the cleaning-member wire 102, the grid wire 104, the developing-roller wire 106, and the discharge-wire wire 108, and controls the leak between the respective wires. The guide wall 116 is provided so as to extend along the wiring direction of the respective wires. On the guide wall 116, a plurality of locking hooks 117 having an L-shaped cross-section are provided so as to lock the respective wires. On the guide wall 116, a plurality of supporting shafts 118 are provided so as to fix the cleaning-member coil 103, the grid coil 105, the discharge-wire coil 109, and the earth coil 112. The respective supporting shafts 118 are disposed in the vicinities of the cleaning-member electrode mount 85, the grid electrode mount 83, the discharge-wire electrode mount 84, and the earth-contact mount 88. The supporting shafts 118 having an L-shaped cross-section are formed so as to project from the outer surface of the right-side wall 70.

On the outer surface of the right-side wall 70, a first boss member 125 serving as a regulating section, a second boss member 126 serving as a supporting section, a coil locking hook 123, and a coil locking member 124 are provided so as to support the developing-roller wire 106, as shown in FIG. 9. The first boss member 125 is formed in the upper side of the developing-roller electrode mount 86, and the second boss member 126 is formed in the front side of the first boss member so as to be spaced at a distance. Both boss members are formed to project outward in the width direction from the outer surface of the left-side wall 70. The coil locking hook 123, of which the outer lower end in the width direction projects downward, is formed to have an L-shaped cross-section in the width direction, and is formed in the rear side of the first boss member 125 so as to be spaced at a distance. The coil locking member 124 having an adunc cross-section is formed in the opposite side to the first boss member 125, with the developing-roller electrode mount 86 being interposed therebetween. Further, the coil locking member 124 is provided so as to be slightly overlapped with the developing-roller electrode mount 86 in the width direction.

(4) Assembling High-Voltage Wiring Section into Right-Side Wall

As shown in FIGS. 5, 6, and 7, the high-voltage wiring section 79 is assembled into the right-side wall 70 by fitting the locked portion 101 into the locking section 115 provided on the second inner surface of the right-side wall 70. The high-voltage wiring section 79 is disposed in the lower side of the process cartridge 20 (refer to FIG. 1), in a state where the process cartridge 20 is mounted on the cartridge accommodating section 72 of the main body casing 2.

Inside the right-side wall 70, the base end portion of the cleaning-member wire 102 is connected to the cleaning-member terminal 96, the base end portion of the grid wire 104 is connected to the grid terminal 97, the base end portion of the developing-roller wire 106 is connected to the developing-roller terminal 98, the base end portion of the discharge-wire wire 108 is connected to the discharge-wire terminal 99, and the base end portion of the transfer-roller wire 110 is connected to the transfer-roller terminal 100. In the respective wires, portions between the free end portion and the base end portion are disposed along the guide wall 116 outside the right-side wall 70. The respective wires are locked to the locking hooks 117 of the guide wall 116.

The respective winding sections of the cleaning-member coil 103, the grid coil 105, and the discharge-wire coil 109 are inserted into the supporting shafts 118 in the outside of the right-side wall 70, and are assembled so that one-side arms are locked by the guide wall 116. Accordingly, the other-side arms which are not locked by the guide wall 116 are exposed to the inside of the right-side wall 70 from the above-described mounts by the deflection force of the respective coils.

Specifically, the other-side arm of the cleaning-member coil 103 is exposed to the inside of the right-side wall 70 from the cleaning-member electrode mount 85, the other-side arm of the grid coil 105 is exposed to the inside of the right-side wall 70 from the grid electrode mount 83, and the other-side arm of the discharge-wire coil 109 is exposed to the inside of the right-side wall 70 from the discharge-wire electrode mount 84, as shown in FIG. 8.

As shown in FIG. 7, the free end portion of the cleaning-member wire 102 is connected to one-side arm of the cleaning-member coil 103, the free end portion of the grid wire 104 is connected to one-side arm of the grid coil 105, and the free end portion of the discharge-wire wire 108 is connected to one-side arm of the discharge-wire coil 109.

As shown in FIG. 5, the transfer-roller plate spring 111 having a rectangular plate shape is disposed along the front and rear direction inside the right-side wall 70, and the rear end portion thereof is fixed to the inner surface of the right-side wall 70 so that the front end portion thereof is overlapped with the transfer-roller electrode mount 87 in the width direction. Accordingly, the rear end portion of the transfer-roller plate spring 111 is supported by the inner surface of the right-side wall 70 so that the front end portion thereof can swing.

The free end portion of the transfer-roller wire 110 is connected to the rear end portion of the transfer-roller plate spring 111, as shown in FIG. 7.

When the developing-roller coil 107 is mounted on the right-side wall 70, the coil winding section 120 of the developing-roller coil 107 is externally fitted into the first boss member 125 between the outer surface of the right-side wall 70 and the coil locking member 124, so that the width-broad section 127 faces the guide groove 119 inside the right-side wall 70 from the developing-roller electrode mount 86. Further, the support winding section 128 of the wire-side coil arm 121 is externally fitted into the second boss member 126. The locking-hook-side coil arm 122 is locked to the coil locking hook 123 so that the coming off thereof to the front side is regulated by the first and second L-shaped sections 129 and 130 and the movement thereof in the width direction is regulated.

Accordingly, the developing-roller coil 107 is assembled into the outside of the right-side wall 70 so that the wire-side coil arm 121 and the locking-hook-side coil arm 122 are respectively supported by the second boss member 126 and the coil locking hook 123.

If the wire-side coil arm 121 and the locking-hook-side coil arm 122 are respectively supported, the coil winding section 120 is biased downward by the deflection forces of thereof so as to move downward. Inside the coil winding section 120, however, the first boss member 125 is inserted so that the coil winding section 120 is loosely fitted so as to swing in the upward and downward direction. When the upper surface of the first boss member 125 is abutted on the upper inner circumference of the coil winding section 120, the downward movement of the coil winding section 120 is regulated. As shown in FIG. 8, the first boss member 125 sets the downward moving range of the coil winding section 120 such that an exposure length X in the upward and downward direction of the exposed portion of the coil winding section 120, which is exposed to the inside of the guide groove 119 from the developing-roller electrode mount 86, is smaller than the outer diameter Y of the drum shaft 34 of the photosensitive drum 28.

As shown in FIG. 10, the wire winding section 136 provided in the free end portion of the developing-roller wire 106 is externally fitted into the second boss member 126, into which the support winding section 128 is externally fitted, from outside of the width direction (The width direction is parallel to the overlapping direction of the conductive wires of the coil winding section 120 in the assembled developing-roller coil 107).

The wire winding section 136 is biased inward in the width direction at all times, because the developing-roller wire 106 is supported along the wire wall 116 by the locking hook 117.

Therefore, if the wire winding section 136 is externally fitted into the second boss member 126, the support winding section 128 is pressed toward the base end portion of the second boss member 126, that is, inward in the width direction by the wire winding section 136.

Accordingly, the wire winding section 136 inserted into the second boss member 126 is disposed so as to come in contact with the support winding section 128 in the free end portion side of the second boss member 126, that is, outward in the width direction with respect to the support winding section 128. Then, the developing-roller wire 106 and the developing-roller coil 197 are connected to each other.

(5) Assembling Earth Section into Right-Side Wall

As shown in FIG. 6, the earth plate 113 is disposed along the oblique upper and lower direction outside the right-side wall 70, and both end portions thereof in the longitudinal direction are fixed to the outer end portion (free end portion) of the guide wall 116 in the width direction.

Outside the right-side wall 70, the earth coil 112 is assembled so that the winding section thereof is inserted into the supporting shaft 118 and one-side arm is locked to the hole 114 of the earth plate 113. Accordingly, the other arm which is not locked to the guide wall 116 is exposed to the inside of the right-side wall 70 from the earth-contact mount 83 by the deflection force of the earth coil 112 (refer to FIG. 8).

(6) Mounting Process Cartridge on Cartridge Accommodating Section of Main Body Casing.

As shown in FIG. 1, the process cartridge 20 is mounted into the cartridge accommodating section 72 from the attaching/detaching opening 6 of the main body casing 2 toward an arrow direction of FIG. 2. At this time, both end portions of the drum shaft 34 of the photosensitive drum 28 in the width direction, provided in the rear side of the process cartridge 20, are introduced into the guide groove 119 on the inner surface of the right-side wall 70 and the guide groove on the inner surface of the left-side wall 71. Then, both end portions in the width direction are guided so as to follow a track shown by a chained line of FIG. 8.

As the drum shaft 34 of the photosensitive drum 28 of the process cartridge 20 is moved from the front side to the rear side along the track shown by the chained line of FIG. 8, the upward and downward movement of the drum shaft 34 of the photosensitive drum 28 is increasingly regulated because the space in the upper and lower direction of the substantially-triangle guide groove 119 is narrowed.

While the drum shaft 34 is moved, the earth contact 89 of the drum shaft 34 comes in sliding contact with and is detached from the coil winding section 120 of the developing-roller coil 107 exposed downward from the developing-roller electrode mount 86 in the middle of guide groove 119 in the front and rear direction. After that, if the drum shaft 34 reaches the innermost portion of the guide groove 119, the process cartridge 20 is completely mounted on the cartridge accommodating section 72. If the process cartridge 20 is mounted on the cartridge accommodating section 72, the earth contact 89 of the drum shaft 34 is pressed in the width direction against the earth coil 112 projecting inward in the width direction from the earth-contact mount 88. Accordingly, the photosensitive drum 28 is grounded.

Simultaneously, the developing-roller electrode 95 of the developing roller 38 is pressed against the broad-width section 127 of the coil winding section 120 from the front side of the downward direction (that is, the direction where the coil winding section 120 is abutted on the developing-roller electrode 95), the broad-width section 127 of the coil winding section 120 being exposed downward from the developing-roller electrode mount 86, as shown in FIG. 3. Accordingly, in the developing-roller electrode 95, a developing bias is applied from the high-voltage generating substrate 80 through the developing-roller terminal 98, the developing-roller wire 106, and the developing-roller coil 107.

If the developing-roller electrode 95 is pressed against the coil winding section 120, the coil winding section 120 is pressed upward against the deflection force of the wire-side coil arm 121 and the locking-hook-side coil arm 122 so as to be moved slightly upward, as shown in FIG. 11. Then, the upper inner surface of the coil winding section 120 is separated upward from the upper surface of the first boss member 125.

As shown in FIGS. 3 and 8, the cleaning-member electrode 93 is pressed in the width direction against the other-side arm of the cleaning-member coil 103 which is exposed toward the inside of the right-side wall. Accordingly, in the cleaning-member electrode 93, a cleaning bias is applied from the high-voltage generating substrate 80 through the cleaning-member terminal 96, the cleaning-member wire 102, and the cleaning-member coil 103.

The grid electrode 91 is pressed in the width direction against the other-side arm of the grid coil 105 which is exposed toward the inside of the right-side wall 70. Accordingly, in the grid electrode 91, a grid bias is applied from the high-voltage generating substrate 80 through the grid terminal 97, the grid wire 104, and the grid coil 105.

Further, the discharge-wire electrode 90 is pressed in the width direction against the other-side arm of the discharge-wire coil 109 which is exposed toward the inside of the right-side wall 70. Accordingly, in the discharge-wire electrode 90, a high voltage is applied from the high-voltage generating substrate 80 through the discharge-wire terminal 99, the discharge-wire wire 108, and the discharge-wire coil 109.

The transfer-roller electrode 92 is pressed in the width direction against the front end portion of the transfer roller plate spring 111 which is fixed to the inner surface of the right-side wall 70. Accordingly, in the transfer-roller electrode 92, a transfer bias is applied from the high-voltage generating substrate 80 through the transfer-roller terminal 100, the transfer-roller wire 110, and the transfer-roller plate spring 111.

3. Effect of Present Aspect

In the above-described laser printer 1, the wire-side coil arm 121 and the locking-hook coil arm 122 are respectively supported by the second boss member 126 and the coil locking hook 123 so that the coil winding section 120 of the developing-roller coil 107 is pressed in the upward and downward direction against the developing-roller electrode 95 in the right-side wall 70. That is, the coil winding section 120 is pressed against the developing-roller electrode 95 in a state where the wire-side coil arm 121 and the locking-hook-side coil arm 122 are supported. Therefore, the upward and downward swing range of the coil-winding section 120 can be reduced, compared with when the coil-winding section 120 swings in a state where only one end thereof is supported. As a result, a projected area which is needed to dispose the coil winding section 120 can be reduced, which makes it possible to achieve the miniaturization of the laser printer 1 provided with the developing-roller coil 107.

Figure 12:
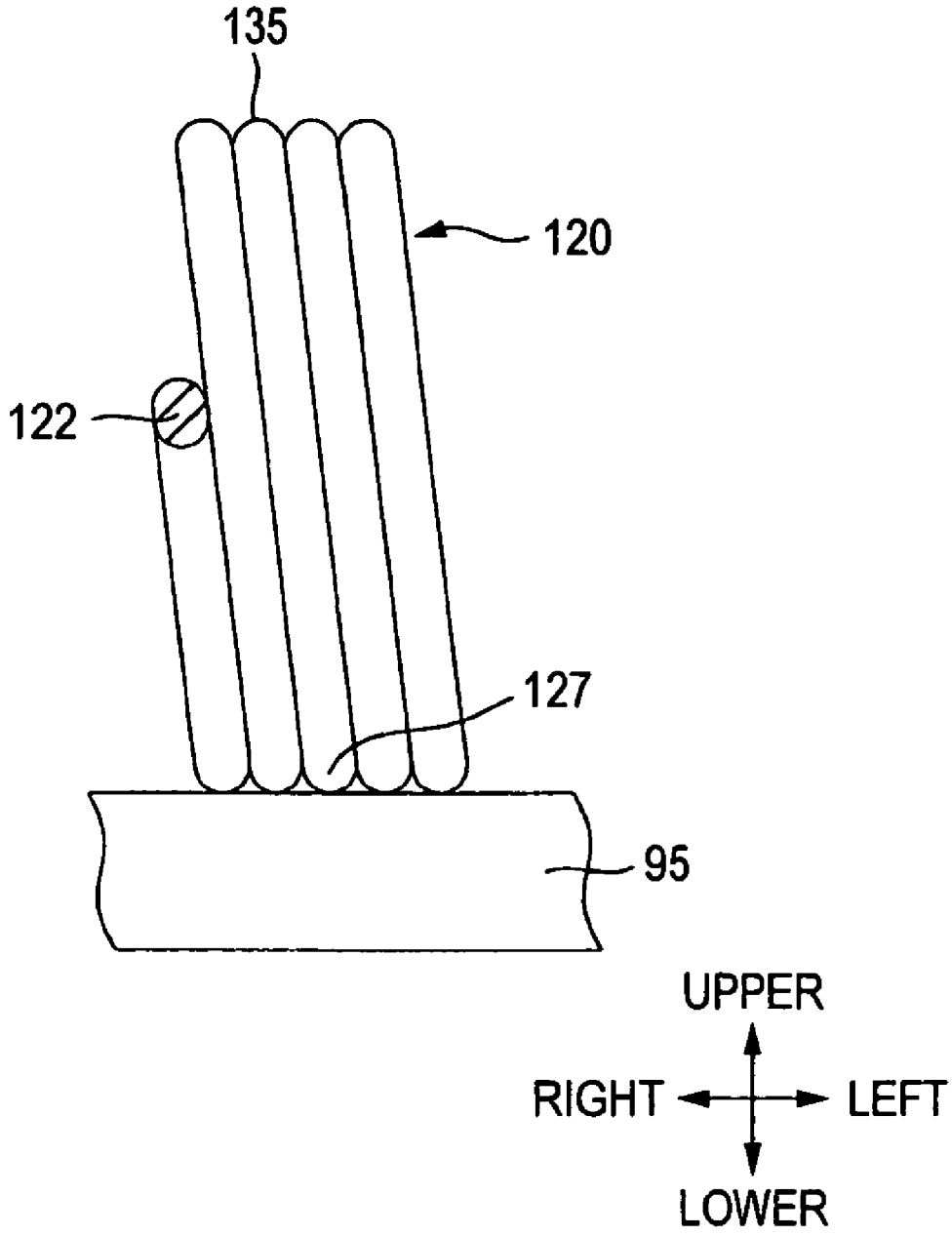
FIG. 12 is a diagram showing a state where a coil winding section of the developing-roller coil is abutted on a developing-roller electrode, seen from the rear side of the width (right and left) direction.

In the developing-roller coil 107, conductive wire is wound in more than two turns around coil winding section 120. Therefore, it is possible to enlarge the contact area with the developing-roller electrode 95 in the width direction, as shown in FIG. 12. Accordingly, the narrow-width section 135 facing the broad-width section 127, which is abutted on the developing-roller electrode 95, in the upward and downward direction can be prevented from being inclined in the width direction. As a result, it is possible to prevent the coil winding section 120 from falling in the width direction.

In the coil winding section 120, the broad-width section 127 is formed to have a larger width than the narrow-width section 135, and the developing-roller electrode 95 is pressed against the broad-width section 127. Therefore, even when winding is performed in the same number of turns, the contact area with the developing-roller electrode 95 can be enlarged without increasing the number of turns of the coil-winding section 120, compared with when the developing-roller electrode 95 is pressed against the narrow-width section 135. Accordingly, it is possible to reliably prevent the coil winding section 120 from falling in the width direction.

Before the process cartridge 20 is mounted, the downward movement of the coil winding section 120 is regulated by the first boss member 125 into which the coil winding section 120 is loosely fitted. Therefore, the coil winding section 120 can be pressed against the developing-roller electrode 95 in a proper contact position. Further, when the process cartridge 20 is attached and detached to and from the main body casing 2, the coil winding section 120 can be prevented from being abutted on portions other than the developing-roller electrode 95 in the process cartridge 30.

Particularly, the first boss member 125 sets the downward moving range of the coil winding section 120 such that the exposure length X in the upward and downward direction of the exposed portion of the coil winding section 120, which is exposed to the inside of the guide groove 119 from the developing-roller electrode mount 86, is smaller than the outer diameter Y of the drum shaft 34 of the photosensitive drum 28. Therefore, when the process cartridge 20 is mounted, it is possible to prevent the drum shaft 34 from being fitted into the coil winding section 120 before the developing-roller electrode 95 is pressed against the coil winding section 120. Even when the process cartridge 20 is detached, it is possible to prevent the drum shaft 34 from being fitted into the coil winding section 120 after the developing-roller electrode 95 is separated from the coil winding section 120.

In the wire-side coil arm 121 of the developing-roller coil 107, the support winding section 128 is provided in the free end portion thereof and is externally fitted into the second boss member 126, thereby supporting the wire-side coil arm 121. Therefore, the movement of the wire-side coil arm 121 to every direction orthogonal to the projecting direction (width direction) of the second boss member 126 is regulated so that the wire-side coil arm 121 is positioned. Accordingly, the coil winding section 120 can be reliably pressed against the developing-roller electrode 95.

In the second boss member 126, the wire winding section 136 is disposed so as to come in contact with the support winding section 128 in the free end portion side of the second boss member 126. Therefore, the movement of the support winding section 128 to the free end portion side of the second boss member 126 in the projecting direction of the second boss member 126 is regulated so that the support winding section 128 is positioned. Accordingly, the coil winding section 120 can be further reliably pressed against the developing roller electrode 95.

In the wire-side coil arm 121 of the developing-roller coil 107, the first L-shaped portion 129 and the second L-shaped section 130 are provided in the free end portion thereof. The wire-side coil arm 121 is supported by the coil locking hook 123 so that the coming-off thereof to the front side is regulated by the first and second L-shaped portions 129 and 130 and the movement thereof to the width direction is regulated by the coil locking hook 123. Therefore, when the wire-side coil 121 is engaged with the coil locking hook 123, the developing-roller coil 107 can be simply and reliably supported while the coil winding section 120 is accurately positioned.

What is claimed is:

1. An image forming apparatus comprising:

a process cartridge that includes a power supplied member;

a casing that includes an accommodating section for detachably accommodating the process cartridge; and a power supplying member that is provided in the accommodating section and is abutted on the power supplied member of the mounted process cartridge, the power supplying-member comprises a conductive wire including a winding section and two arms having the conductive wire extending from the winding section in a different direction, wherein the accommodating section is provided with supporting sections that respectively support the two arms such that the power supplied member of the mounted process cartridge is abutted on the winding section and the conductive wire is wound in a plurality of turns in the winding section.

2. The image forming apparatus according to claim 1, wherein the winding section comprises:

a broad-width section that is disposed between both end portions of the winding section to which the respective arms continue; and a narrow-width section that is disposed so as to interpose the broad-width section in the circumferential direction, the number of turns of the narrow-width section being smaller than the number of turns of the broad-width section, wherein the broad-width section abuts on the power supplied member.

3. The image forming apparatus according to claim 1, wherein the accommodating section is provided with a regulating section that is inserted into the winding section so as to regulate a moving range of the winding section with respect to the power supplied member of the mounted process cartridge.

4. The image forming apparatus according to claim 1, wherein one of the supporting sections which supports one of the arms projects in parallel to an overlapping direction of the conductive wire in the winding section, and the one of the arms is supported while being wound around the one of the supporting sections.

5. The image forming apparatus according to claim 4, further comprising a wiring section that is connected to the power supplying member so as to feed a bias from a power supply to the power supplying member, wherein the wiring section has a connection section that comes in contact with the one of the arms, and the connection section is disposed adjacent to the one of the arms in the free end portion side of the one of the supporting sections with respect to one of the arms and is supported while being wound around the one of the supporting sections.

6. The image forming apparatus according to claim 1, wherein the other supporting section supporting the other arm is formed so that the cross-section thereof in the direction parallel to the overlapping direction of the conductive wire in the winding section is L-shaped, and the other arm is supported while being engaged with the other supporting section so that the movement thereof to the direction parallel to the overlapping direction of the conductive wire in the winding section is regulated.

7. The image forming apparatus according to claim 1, wherein the process cartridge is provided with a shaft section that projects in the same direction as the power supplied member in an upstream side in a mounted direction of the process cartridge with respect to the power supplied member, the accommodating section is provided with a guide groove for guiding the attachment and detachment of the shaft section as the process cartridge is attached and detached, the winding section is disposed so as to face the inside of the guide groove, and a portion facing the inside of the guide groove in the winding section is shorter than a diameter of the shaft section in an abutment direction of the winding section with respect to the power supplied member of the mounted process cartridge.

8. The image forming apparatus according to claim 7, wherein the process cartridge comprises:

a developing roller including a roller section, on which a developer is carried, and a roller shaft disposed in a center of the roller section and supporting the roller section; and a photosensitive drum including a photosensitive cylinder section, on which an electrostatic latent image is formed, and a drum shaft disposed in a center of the photosensitive cylinder section and supporting the photosensitive cylinder section, the electrostatic latent image being developed by supplying the developer carried on the roller section, wherein the shaft section is the drum shaft, and the power supplied member is electrically connected to the roller shaft and is a conducting shaft section extending in parallel to a shaft end portion of the roller shaft.

* * * * *